US005813965A

United States Patent [19]

Mitchell et al.

[11] Patent Number: 5,813,965

[45] Date of Patent: Sep. 29, 1998

[54] MACHINE FOR TRANSFERRING AND ERECTING CARDBOARD PACKAGE BLANKS

[75] Inventors: William R. Mitchell; Thomas E. Brooker, both of Sarasota, Fla.

[73] Assignee: Klockner Bartelt, Inc., Sarasota, Fla.

[21] Appl. No.: 667,089

[22] Filed: Jun. 20, 1996

[51] Int. Cl.[6] ..... B31B 1/80

[52] U.S. Cl. ..... 493/315; 271/95; 271/99

[58] Field of Search ..... 493/312, 313, 493/315, 316, 317; 271/95, 99, 102, 104

[56] References Cited

U.S. PATENT DOCUMENTS

| | | | |
|---|---|---|---|
| 3,302,946 | 2/1967 | Anderson | 271/95 |
| 4,596,545 | 6/1986 | Greenwell | 493/315 |
| 4,629,446 | 12/1986 | Focke | 493/317 |
| 4,854,930 | 8/1989 | Miselli | 493/315 |
| 4,983,154 | 1/1991 | Nagahashi | 493/315 |
| 5,473,868 | 12/1995 | Martelli | 53/566 |
| 5,536,231 | 7/1996 | Nilsson | 493/315 |

*Primary Examiner*—Jack W. Lavinder
*Attorney, Agent, or Firm*—Leydig, Voit & Mayer, Ltd.

[57] ABSTRACT

The machine includes a vacuum head which is mounted to rotate on the outer end of an elongated arm adapted to be pivoted upwardly and downwardly about a fixed pivot by a servo drive. As the arm pivots, the vacuum head picks either a carton blank or a tray blank out of a magazine and transfers the blank toward a conveyor. During the pivoting, the vacuum head is turned relative to the arm and, when the blank is a carton blank, the turning motion brings the blank into engagement with a fixed plow which erects the blank. During final downward movement of the arm, the vacuum head is held parallel to the conveyor and moves toward the conveyor with a vertical plunging motion. When the blank is a tray blank, such vertical plunging causes the blank to be erected by flights on the conveyor as the blank is loaded between the flights.

9 Claims, 5 Drawing Sheets

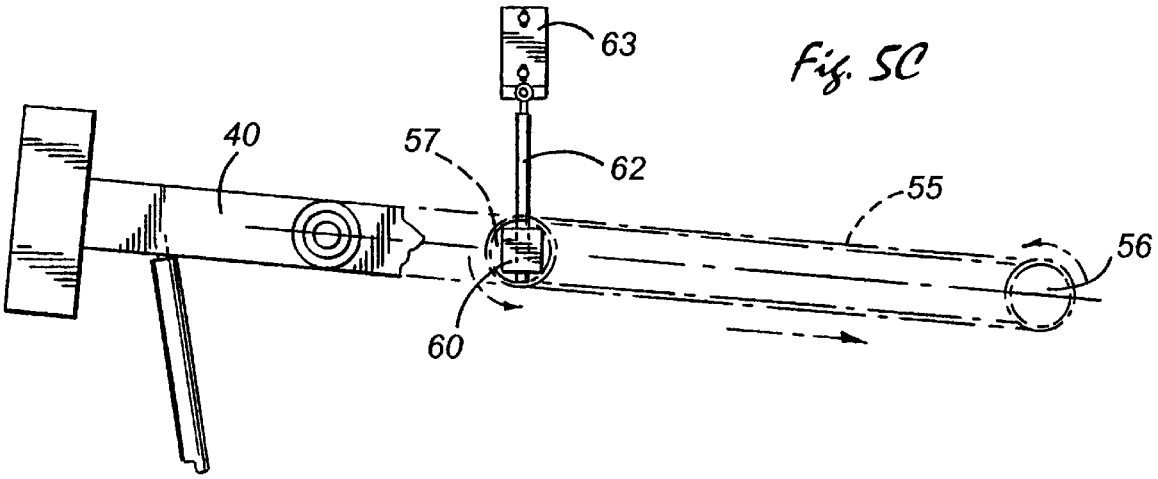
Fig. 5C
Fig. 6
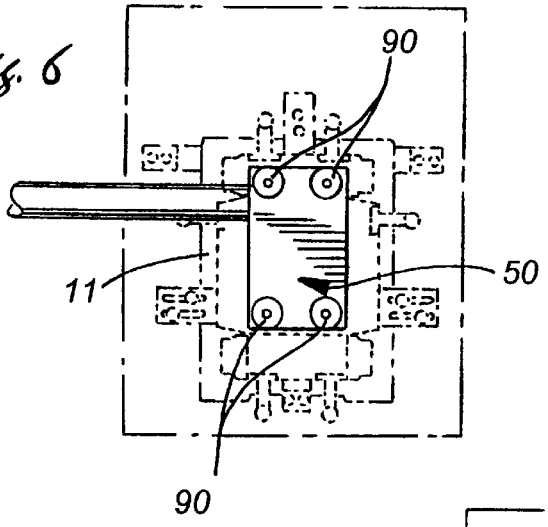
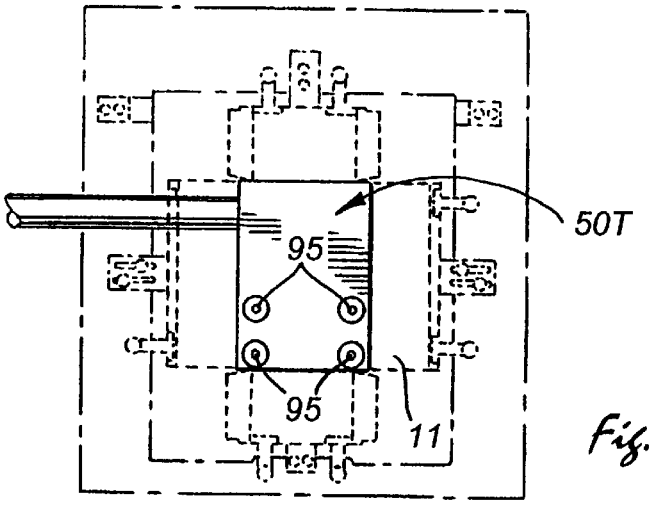
Fig. 7

MACHINE FOR TRANSFERRING AND ERECTING CARDBOARD PACKAGE BLANKS

BACKGROUND OF THE INVENTION

This invention relates to a machine for picking flattened cardboard blanks out of a magazine, transferring the blanks from the magazine to a conveyor, and erecting each blank into a package during the transfer. Such a machine typically constitutes part of a packaging system which fills the packages with product after the packages have been erected and during advance of the packages by the conveyor.

The packages may be in the form of either cardboard cartons or cardboard trays. Cartons are usually of rectangular cross-section when erected. Each carton blank comprises a sheet of paperboard which is appropriately folded and glued to form four panels hingedly joined together along weakened fold lines formed by scoring the paperboard. When the blank is erected from a flattened condition, two of the panels define opposing top and bottom panels while the other two panels form side panels which extend vertically between the top and bottom panels. Erection of the blank into a carton is effected by moving the blank with a turning motion into engagement with a fixed plow as the blank is transferred from the magazine to the conveyor.

A typical tray is formed by a bottom panel and by two opposing side panels which project upwardly from and are hingedly connected to the bottom panel. When the tray is in flattened blank form, all three panels are disposed in a single plane. During transfer of the blank from the magazine to the conveyor, the blank is plunged vertically into a pocket defined between leading and trailing upstanding flights on the conveyor. The flights engage the side panels and cam the side panels upwardly from the bottom panel in order to erect the tray.

Thus, a turning motion is required during the transfer in order to erect a blank into a carton while a vertical plunging motion is required in order to erect a blank into a tray. In some cases, one machine is used to transfer and erect cartons and a separate machine is used to transfer and erect trays. Presently available machines which are capable of transferring and erecting both cartons and trays are compelled to operate at relatively low speeds as a result of experiencing rather severe vibration when operated at higher speeds.

SUMMARY OF THE INVENTION

The general aim of the present invention is to provide a new and improved combination transfer machine capable of producing turning motion for erecting cartons and vertical plunging motion for erecting trays and capable of operating at significantly higher speeds and with less vibration than prior machines of the same general type.

A more detailed object of the invention is to achieve the foregoing by providing a machine wherein an arm which carries a vacuum head for transferring the blanks is pivoted upwardly and downwardly by a speed controllable servo drive while the vacuum head is turned relative to the arm in timed relation with pivoting of the arm by a mechanical drive located relatively close to the pivot point of the arm.

Still another object of the invention is to provide a transfer machine in which the mechanical drive for establishing vertical plunging of the vacuum head also causes the vacuum head to approach and recede from the magazine with a motion which is conducive to fast and trouble-free stripping of cardboard blanks from the magazine.

The invention also resides in the ability to adjust the entire transfer machine vertically relative to the conveyor so as to enable the machine to handle both cartons and trays and to handle cartons of various heights.

These and other objects and advantages of the invention will become more apparent from the following detailed description when taken in conjunction with the accompanying drawings.

BRIEF DESCRIPTION OF THE DRAWINGS

FIGS. 5A, 5B and 5C are side elevational views showing successive positions of various components of the machine as a cardboard blank is transferred from the magazine to the conveyor.

FIG. 6 is a plan view of a vacuum head used for transferring a carton blank.

FIG. 7 is a plan view of a vacuum head used for transferring a tray blank.

Figures 1, 2:
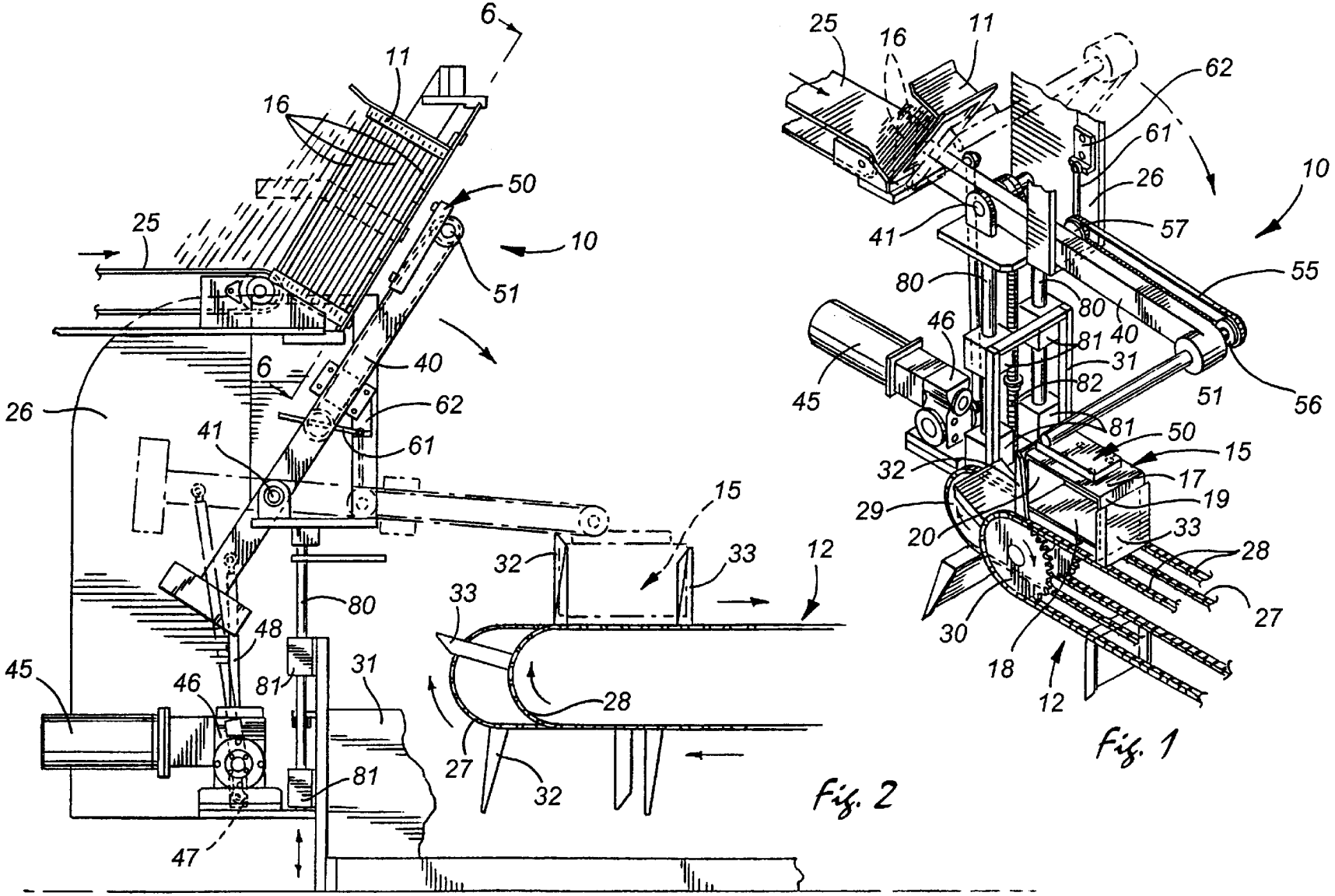
FIG. 1 is a fragmentary perspective view of a new and improved transfer machine incorporating the unique features of the present invention, the machine being shown as set up to transfer and erect carton blanks and being shown as positioned during final delivery of an erected carton to the conveyor.
FIG. 2 is a fragmentary side elevational view of the machine illustrated in FIG. 1 and shows the machine substantially in position to pick a carton blank out of the magazine.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENTS

As shown in the drawings for purposes of illustration, the invention is embodied in a machine 10 for transferring flattened cardboard blanks from a magazine 11 to a conveyor 12 and for erecting each blank into a package during the transfer. In the machine shown in FIGS. 1–3, the packages are cartons 15 of generally rectangular cross-section. Each carton is erected from an initially flat blank 16 stored in the magazine 11. The carton includes top and bottom panels 17 and 18 (FIG. 1) connected to one another by vertically extending side panels 19 and 20 which are hingedly joined to the top and bottom panels along scored fold lines. When the blanks 16 are in the magazine, the panels are collapsed and are positioned with the top and bottom panels disposed in closely spaced face-to-face relation with one another. After the carton has been erected and filled with product, end flaps (not shown) hingedly connected to the panels are folded over the ends of the carton in order to close the carton.

Figure 4:
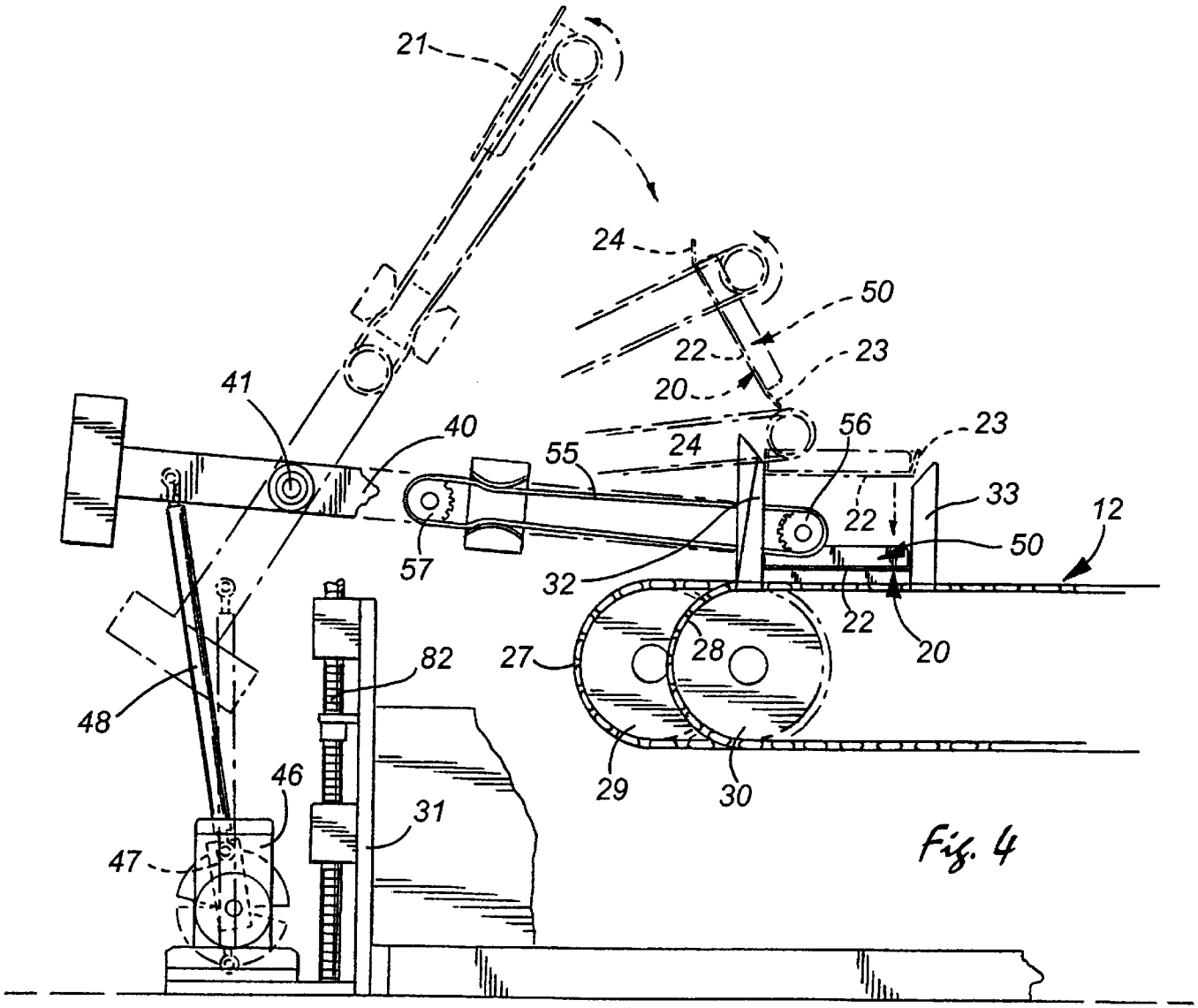
FIG. 4 is a view similar to FIG. 3 but shows the machine placing an erected tray on the conveyor.

In FIG. 4, the packages are shown as being open top trays 20 which are erected from initially flat cardboard blanks 21.

Each tray includes a bottom panel 22 and two side panels 23 and 24 joined to the bottom panel along scored fold lines. The three panels initially are in the same plane and, when the tray is erected, the side panels are folded upwardly from the bottom panel and into substantially vertical positions. End panels (not shown) are subsequently folded upwardly into position to close the ends of the tray, the top of the tray being closed by film or by a lid after the tray has been filled with product.

The magazine 11 for storing the blanks 16, 21 is of conventional construction and is associated with an endless belt 25 which maintains a supply of blanks in the magazine. The magazine and the belt are supported on a large subframe 26. When in the magazine, the blanks are inclined downwardly toward the conveyor 12 at an angle of about 30 degrees relative to vertical. Carton blanks 16 are held in the magazine with their top panels 17 facing downwardly and outwardly while tray blanks 21 are held with the inside or upper surfaces of their bottom panels 22 facing downwardly and outwardly.

In this instance, the conveyor 12 is formed by longitudinally staggered and horizontally extending endless chains 27 and 28 trained around sprockets 29 and 30, respectively, the conveyor being supported by a main base or frame 31. Flights 32 and 33 formed by plate-like members are attached to the chains 27 and 28, respectively, and project upwardly from the upper runs thereof. Each flight 33 of the chain 28 coacts with the adjacent trailing flight 32 of the chain 27 to define a pocket for a package 15, 20. The chains are driven intermittently and, each time the chains dwell, a package 15, 20 erected from a blank 16, 21 is placed in the extreme upstream pocket of the upper runs of the chains. Product is placed in each package in a conventional manner at a downstream station following indexing of the chains.

Erection of a blank 16 into a carton 15 is effected by turning the blank with a rotary motion and into engagement with a plow 35 (FIG. 3) as the blank is transferred from the magazine 11 toward the conveyor 12.

The plow is located in a fixed position just above the leading flight 33 of the pocket which is to receive the carton 15. As the carton blank is moved downwardly and turned into engagement with the plow, the edge of the blank extending between the bottom panel 18 and the leading side panel 19 cams against the plow as shown in phantom lines in FIG. 3. The camming action breaks the carton blank into an open condition for placement into the pocket.

Trays 20 are erected by moving the tray blanks 21 with a vertical plunging motion between the flights 32 and 33 and into the pocket defined therebetween. As the blank is plunged vertically, the side panels 23 and 24 engage the flights 33 and 32, respectively, and are cammed upwardly into upstanding relation with the bottom panel 22. After the tray has been placed in the pocket, the flights hold the side panels in upright positions.

The present invention contemplates a transfer machine 10 capable of operating smoothly and at high speeds and capable of delivering blanks 16, 21 from the magazine 11 toward the conveyor 12 both with a turning motion and with a vertical plunging motion so that either cartons 15 or trays 20 may be erected during the transfer of the blanks. The machine includes an elongated arm 40 which is pivotally mounted at 41 on the subframe 26 to swing upwardly and downwardly about a horizontal axis. Pursuant to the invention, up and down pivoting of the arm is effected by an electric servo motor 45 which acts through a speed reducer 46 to rotate a crank arm 47. The latter is pivotally connected to one end of an elongated link 48 whose other end is pivotally connected to the pivot arm 40. The motor is adapted to be intermittently and unidirectionally energized and, when energized through a complete cycle, acts through the speed reducer 46, the crank arm 47 and the link 48 to oscillate the pivot arm 40 downwardly and then upwardly through an angle of approximately 60 degrees about the pivot point 41. The motor is electronically controlled so as to cause the pivot arm to oscillate through one complete cycle each time the conveyor 12 is indexed through one cycle. The speed of the servo motor may be precisely controlled so as to effect smooth acceleration and deceleration of the arm and to modulate the harmonic motion produced by the crank arm 47.

A vacuum head 50 (to be described in more detail subsequently) is carried by the outer end portion of the pivot arm 40. Herein, the vacuum head is mounted on one end portion of an elongated shaft 51 (FIG. 1) which projects laterally from the arm. The other end portion of the shaft extends through and is rotatably supported by the arm. During oscillation of the arm, the vacuum head moves upwardly into proximity with the magazine 11 and picks a blank 16, 21 out of the magazine. As the arm is swung downwardly, the vacuum head is rotated relative to the arm and locates the blank in a position to be erected and placed on the conveyor 12.

In carrying out the invention, the vacuum head 50 is rotated relative to the pivot arm 40 by a mechanical intermittent drive which enables the blank 16, 21 to be moved both with a turning motion and with a vertical plunging motion and which enables the transfer from the magazine 11 to the conveyor 12 to be carried out with low vibration and at relatively high speeds. In this instance, the drive for rotating the vacuum head includes a cogged timing belt 55 (FIG. 1) which is trained around a first timing gear or cogged wheel 56 on the end of the shaft 51 and a second timing gear or cogged wheel 57 rotatably supported by the arm 40 at a location between the pivot point 41 and the outer end of the arm and substantially closer to the pivot point than to the outer end of the arm. When rotated, the wheel 56 acts through the shaft 51 to turn the vacuum head 50 relative to the arm 40. In this instance, the speed ratio between the wheels 56 and 57 is approximately 5:6.

To rotate the wheel 56 and the vacuum head 50, a block 60 (FIG. 5A) is attached securely to the inboard wheel 57 and, as the pivot arm 40 is swung upwardly and downwardly, rotates the wheel 57 so as to drive the belt 55 and effect rotation of the wheel 56. For this purpose, a rod 61 is slidably supported by the block 60 and is pivotally connected at one end at 62 to a bracket 63 which is fixed to the subframe 26.

Figure 5A:
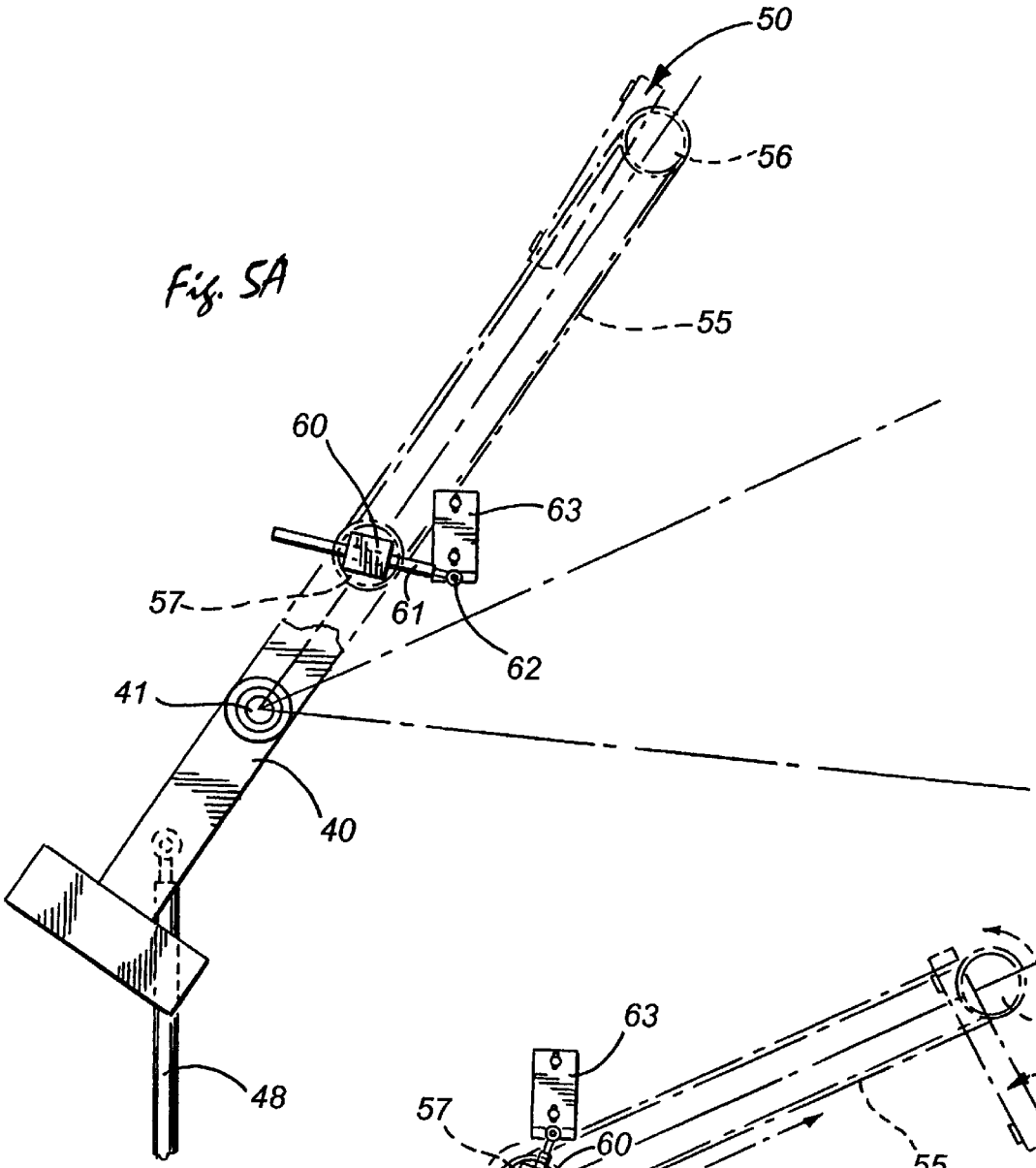
Figure 5B:
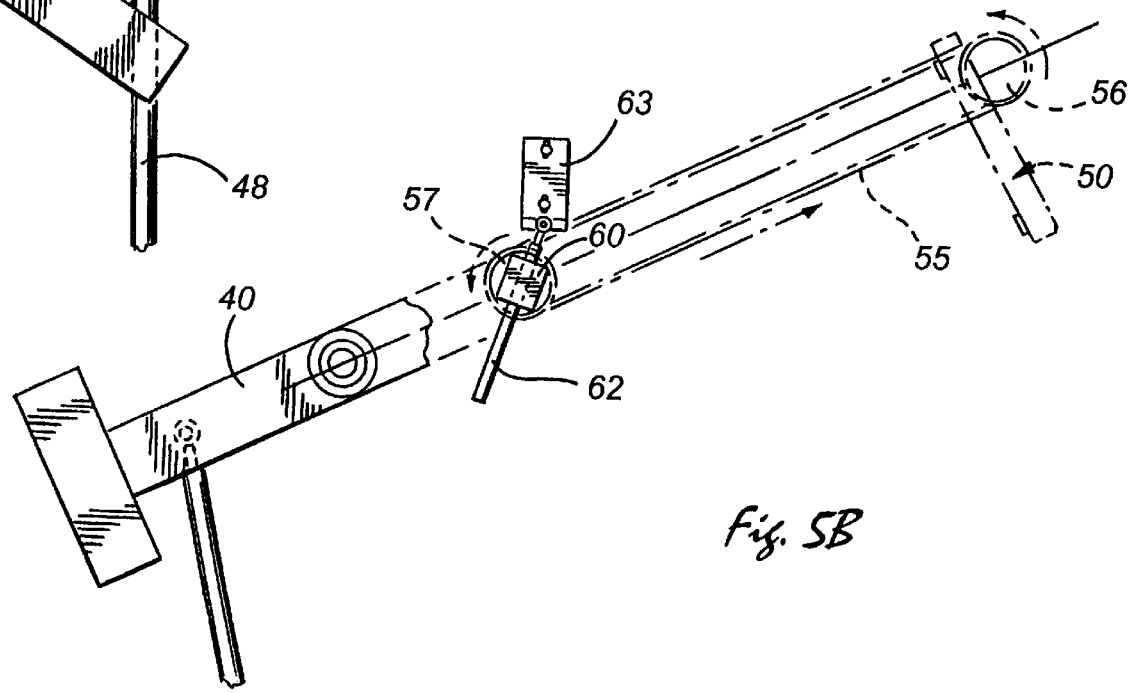

When the pivot arm 40 is in a pick position immediately adjacent the magazine 11, the rod 61 is almost horizontal as shown in FIG. 5A. As the arm is swung downwardly, the fixed bracket 63 forces the rod to slide relative to the block 60 and at the same time to turn in a counterclockwise direction about the pivot 62 while acting through the block to rotate the wheel 57 in a counterclockwise direction. The belt 55 thus is driven counterclockwise to effect rotation of the vacuum head 50 in a like direction. In the first approximately 30 degrees of downward swinging of the arm, the vacuum head rotates counterclockwise relative to the arm from the pick position of FIG. 5A through a relatively large angle (i.e., about 100 degrees) to the position shown in FIG. 5B. In the next approximately 25 degrees of downward swinging of the arm, the rod 61 continues to turn the wheel 57 and the vacuum head 50 counterclockwise relative to the arm through an additional angle of about 90 degrees so as to locate the vacuum head in a nearly horizontal position. In the final approximately 5 degrees of downward swinging of the arm, the rod 61 approaches a vertical position as shown in FIG. 5C, and the block 60 for the most part simply slides relative to the rod without being significantly turned by the rod. Accordingly, during final downward swinging of the arm 40, the rod produces very little counterclockwise turning of the vacuum head 50 and leaves the latter in a substantially horizontal position as the arm completes its downward stroke. Indeed, during final downward movement of the arm 40 beyond a horizontal position, the rod 61 swings past vertical as shown in FIG. 5C and produces a slight clockwise rotation of the wheel 57 and the vacuum head 50 so as to keep the vacuum head in a horizontal position upon completion of the downward stroke of the arm as the latter swings downwardly beyond horizontal.

Figure 3:
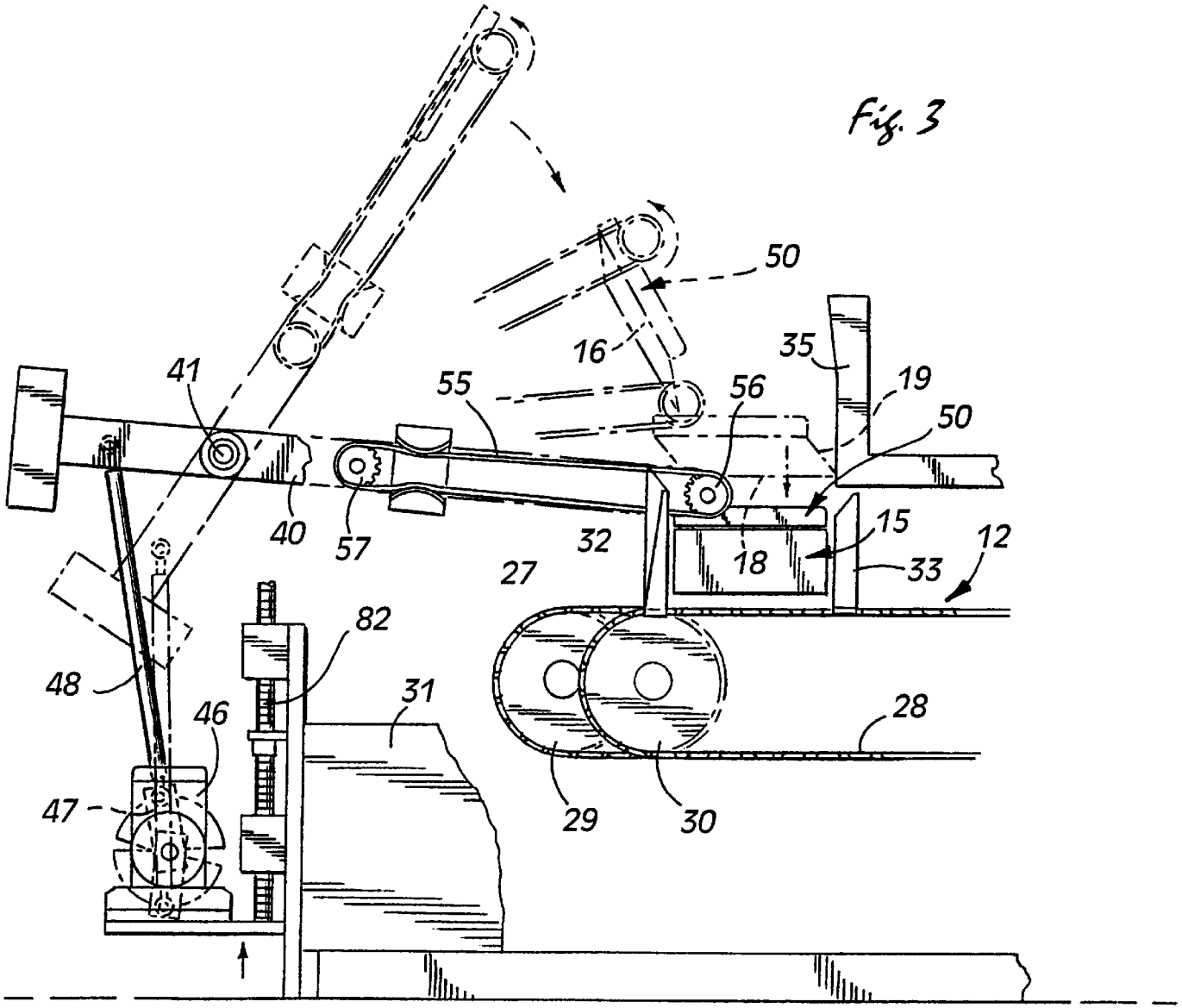
FIG. 3 is an enlarged fragmentary view generally similar to FIG. 2 but shows the machine placing the erected carton on the conveyor.

FIG. 3 shows the operation of the machine 10 during transfer and erection of a carton blank 16. A previously erected carton 15 is deposited in a pocket between two adjacent flights 32 and 33 of the conveyor 12 as the arm 40 completes its downward stroke and while the conveyor is stationary. After the carton has been released by the vacuum head 50, the arm is swung upwardly and, as soon as the vacuum head clears the trailing flight 32, the conveyor is indexed to bring the next pocket to the receiving position. As the arm is swung upwardly, the rod 61 swings clockwise about the pivot 62 and acts through the block 60 to turn the vacuum head clockwise relative to the arm and into position to pick up the next carton blank 16 in the magazine 11.

Advantageously, the rod 61 causes the vacuum head 50 to assume a position parallel to the carton blank 16 in the magazine 11 as the vacuum head approaches the magazine. The vacuum head remains in that position as the arm completes its upward stroke and thus moves toward the magazine with a substantially straight-line plunging motion to facilitate gripping of the carton blank by the vacuum head.

When the arm 40 is swung fully upwardly to the pick position shown in FIG. 5A, the vacuum head 50 grips the leading carton blank 16 in the magazine 11. The arm then is swung downwardly and, during such swinging, the rod 61 turns the vacuum head 50 and the carton blank 16 relative to the arm 40 and through the positions shown in phantom lines in FIG. 3. As the carton blank is turned relative to the arm, its lower leading edge engages the plow 35 so as to break the carton into an open position. When the vacuum head is horizontal and parallel to the conveyor with the carton 15 just above the flights 32 and 33, the arm 40 dwells momentarily in a home position as the conveyor 12 completes its index. The arm then completes its downward stroke, moving to a final position shown in full lines in FIG. 3, and moves the carton into the conveyor pocket with a vertical plunging motion as a result of the rod 61 and the block acting as a brake to first retard and then reverse rotation of the vacuum head 50 relative to the arm and to maintain the head in a substantially horizontal attitude. After the carton has been placed on the conveyor, the vacuum head releases the carton and is retracted to permit indexing of the conveyor.

The operation of the machine 10 during transfer and erection of a tray blank 21 is shown in FIG. 4. After a previously erected tray 20 has been placed on the stationary conveyor 12, the vacuum head 50 releases the tray, and the arm 41 is swung upwardly. As with the case of a carton 15, the conveyor is indexed as soon as the vacuum head clears the trailing flight 32. During upward swinging of the arm 40, the vacuum head is turned clockwise relative to the arm and into position to pick up the next carton blank in the magazine when the arm is swung fully upwardly to the pick position. The vacuum head moves toward the magazine with a plunging motion and along a path generally perpendicular to the blank to enable the vacuum head to be in an optimum position to grip the blank.

After the vacuum head 50 has gripped the upper side of the bottom panel 22 of the leading tray blank 21 in the magazine 11, the arm 40 is swung downwardly. As before, the vacuum head is turned counterclockwise relative to the arm during the downward swinging until the arm reaches the home position (see FIG. 5C), at which time the vacuum head is positioned substantially parallel to the conveyor 12 and is located just above the flights 32 and 33. The vacuum head dwells momentarily in the home position as the conveyor completes its index and, as the arm 40 swings downwardly through its remaining approximately five degrees of travel, the braking or retarding action effected by the rod 61 and the block 60 holds the vacuum head substantially parallel to the conveyor 12. Accordingly, the vacuum head and the tray blank 21 move downwardly with a substantially vertical plunging motion. As the side panels 23 and 24 of the vertically moving blank engage the upper ends of the flights 33 and 32, the side panels are cammed upwardly into substantially vertical positions. The vacuum head acts as a mandrel to facilitate upward folding of the side panels. Thus, the tray 20 is erected as an incident to being inserted into the pocket between the flights.

To summarize, the action of the rod 61 and the block 60 causes the vacuum head 50 to turn as the vacuum head approaches the home position. The turning motion enables a carton blank 16 to properly engage the plow 34 and be cammed into an erected condition. When the vacuum head leaves the home position after momentarily dwelling, it moves with a vertical plunging motion. This permits both cartons 15 and trays 20 to be placed between the flights 32 and 33 and, in the case of a tray, enables the flights to cam the flaps 23 and 24 into erected positions. The vacuum head also moves with a substantially straight-line plunging motion as it approaches and recedes from the magazine 11. As a result, the vacuum head is optimally positioned both to grip blanks in the magazine and to strip the blanks from the magazine.

Because the vacuum head 50 dwells in the home position just above the conveyor 12, the servo motor 45 is decelerating as the vacuum head approaches the plow 34. As a result of decelerating during engagement with the plow, the carton is opened gradually and smoothly.

The servo motion attenuates the harmonic acceleration/deceleration inherent in the crank arm 47 so as to cause the arm 40 to smoothly reverse directions. Placement of the intermittent mechanical drive (i.e., the rod 61 and the block 60) for turning the vacuum head 50 near the pivot point 41 of the arm 40 reduces mass at the outer end of the arm and enables the vacuum head to turn more smoothly and with less vibration than prior arrangements where the vacuum head is turned with mechanism located in proximity to the outer end of the arm. The reduction in vibration enables the transfer machine 10 to cycle at higher speeds.

Advantageously, all operating components of the transfer machine 10 are mounted on the subframe 26, which is adapted for selective vertical adjustment relative to the conveyor 12 in order to enable adjustment in the final position of the arm 40 and the vacuum head 50. For this purpose, the subframe includes a pair of vertically extending and laterally spaced rods 80 which are slidably mounted within guide blocks 81 attached to the main frame or base 31. A jack screw 82 (FIGS. 1 and 3) is operably connected between the subframe 26 and the main frame 31 and may be turned to raise and lower the subframe relative to the main frame. With this arrangement, the subframe may be lowered to place the final position of the arm 40 and the vacuum head 50 closer to the conveyor 12 when the machine 10 is handling trays 20 wherein the vacuum head grips the bottom panel 22 of each tray. When the machine is changed over to handle cartons 15, the subframe may be raised to locate the final position of the arm 40 and the vacuum head 50 further away from the conveyor. This enables the vacuum head to properly place a carton on the conveyor while gripping the top panel 17 of the carton and also enables the final position of the vacuum head to be correlated with the height of the carton.

FIG. 6 is a plan view showing a vacuum head 50C which is particularly useful for transferring carton blanks 16. The vacuum head is rectangular and includes four vacuum cups 90 located near the four corners of the head. When the top panel 17 of the carton blank is gripped and pulled by the vacuum head, side tabbing in the magazine 11 frictionally retards movement of the bottom panel 18 so as to pre-open the blank as it is stripped from the magazine.

A vacuum head 50T for transferring trays 20 is shown in FIG. 7. The head 50T also is rectangular but, in this instance, four suction cups 95 are positioned such that, when the head is in its pick position, the cups are located near the lower edge of the head. The cups thus grip the bottom panel 22 of the tray near the leading edge of the bottom panel and cause the tray to peel away from the adjacent tray in the magazine 11. This helps overcome static cohesion between the trays.

What is claimed is:

1. A machine for picking cardboard blanks from a magazine which holds the blanks in a given orientation, opening them, and placing them on a conveyor, the machine comprising:

a pivoting arm having a pivot point, a servo drive at one end portion of the arm for pivoting the arm upwardly and downwardly about the pivot point, and a vacuum head rotatably mounted at the other end portion of the arm;

an intermittent drive on the pivot arm for controlling rotation of the vacuum head on the arm as the arm pivots;

said servo drive pivoting the pivot arm through a range of positions from a pick position in which the vacuum head is adjacent the magazine for picking a blank from the magazine, carrying the blank through a home position in which the vacuum head is disposed in parallel relation to the conveyor but is displaced thereabove, and to a final position in which the vacuum head deposits the blank on the conveyor, means engaging the blank while being carried by the vacuum head to unfold the blank so that the blank is unfolded when deposited on the conveyor, and means for controlling the intermittent drive to rotate the vacuum head from a first angle corresponding to the orientation of the blank in the pick position to a second angle in which the vacuum head is parallel to the conveyor in the home position, and for retarding the intermittent drive as the arm pivots the vacuum head from the home position to the final position, thereby to achieve a plunging motion of the vacuum head from the home position to the final position.

2. A machine for picking folded cardboard blanks from a magazine, opening them, and placing them on a conveyor, the machine comprising:

a pivoting arm having a pivot point, a servo drive at one end portion of the arm for raising and lowering the arm, and a vacuum head at the other end portion of the arm;

an intermittent drive on the pivot arm for controlling rotation of the vacuum head on the arm as the arm pivots;

the intermittent drive causing rotation of the head as the arm pivots toward a home position to rotate the head toward a fixed plow, and restraining rotation of the head as the arm pivots from the home position to a final position to plunge the head between flights on the conveyor, so that the vacuum head has a rotary motion for engaging an edge of a blank with the fixed plow to open the blank as the arm approaches the home position when the blank is a carton, and a plunging motion for causing leading and trailing panels of a blank to engage the flights on the conveyor for folding the panels upwardly when the blank is a tray.

3. A machine as in claim 2 in which the intermittent drive includes a block rotatably mounted on the pivot arm and further includes a rod slidably mounted by said block, means mounting said rod for pivoting about a pivot point disposed in a fixed location with respect to the pivot point of the arm, the pivot point of the rod being oriented with respect to the block such that initial movement of the arm from a pick position to a start position and final movement of the arm from the home position to the final position causes primarily sliding motion of the rod relative to the block, while pivoting of the arm from the start position to the home position causes said rod to slide relative to said block and to rotate said block, thereby to achieve said intermittent drive.

4. A machine as in claim 2 in which the servo drive is a uni-directional rotational drive having a dwell at the home position, the servo drive having an acceleration/deceleration characteristic which assists in opening a carton when the carton engages the fixed plow when the blank is a carton.

5. A machine as in claim 2 wherein the arm and servo drive are mounted on a subframe, the subframe being adjustably fixed to a frame of the conveyor, and adjustment means interconnecting the subframe to the conveyor frame to allow manual adjustment of the height of the arm with respect to the conveyor in switching between trays and cartons.

6. A machine as in claim 3 wherein the intermittent drive further comprises, a timing gear connected to said block, said block and said timing gear being located on said arm much closer to said pivot point than to the outer end of said arm, a second timing gear on a shaft connected to the vacuum head for controlling rotation thereof, and a timing belt connecting said timing gears.

7. A machine as in claim 2 wherein a first interchangeable vacuum head is provided having four suction cups adapted to engage four corners of a major panel when the blank is a carton.

8. A machine as in claim 7 further including a second vacuum head adapted for use when the blank is a tray, four suction cups on the second vacuum head being arranged nearest the leading edge of a major panel of the tray for peeling the tray out of the magazine when the arm pivots from the pick to the start position.

9. A machine for picking folded cardboard blanks from a magazine, erecting the blanks, and placing the erected blanks on a moving conveyor, the machine comprising:

a pivot arm having a pivot point;

a servo drive connected to one end portion of said arm for pivoting the arm upwardly and downwardly about said pivot point;

a vacuum head mounted on the other end of said arm for rotation relative to said arm; said vacuum head being capable of gripping a blank in said magazine and holding the blank for delivery to said conveyor;

a first timing gear rotatably mounted on said arm nearer to the pivot point of the arm than to the other end portion of the arm;

a second timing gear connected to said vacuum head and operable when rotated to rotate said vacuum head relative to said arm;

a timing belt trained around said timing gears and operable to transmit rotation of said first timing gear to said second timing gear;

a rod pivotally mounted to turn about a fixed pivot point extending parallel to the pivot point of said arm;

and means rotatable with said first timing gear and slidably receiving said rod whereby said rod causes said first timing gear and said vacuum head to rotate relative to said arm as said arm is swung downwardly to move said vacuum head between said magazine and said conveyor.

* * * * *